United States Patent [19]

Urbanczyk

[11] Patent Number: 4,755,802

[45] Date of Patent: Jul. 5, 1988

[54] HANDBAG, BRIEFCASE AND LUGGAGE ALARM

[76] Inventor: Felix Urbanczyk, 13964 Midvale Dr., Whittier, Calif. 90602

[21] Appl. No.: 861,405

[22] Filed: May 9, 1986

[51] Int. Cl.[4] ..... G08B 13/06; G08B 13/14

[52] U.S. Cl. ..... 340/571; 340/568; 116/84

[58] Field of Search ..... 340/568, 571, 686, 545, 340/541, 573; 116/84, 85, 100, 99; 200/51 R, 61.58 R, 61.62; 150/101, 102, 133, 134; 190/101, 903; 335/205-207

[56] References Cited

U.S. PATENT DOCUMENTS

| | | | |
|---|---|---|---|
| 1,148,773 | 8/1915 | Helmers | 109/43 |
| 1,730,745 | 10/1927 | Pucek | 340/571 |
| 2,538,101 | 1/1951 | Kelch | 200/61.62 |
| 2,877,439 | 3/1959 | Avery | 200/61.58 R |
| 3,569,645 | 3/1971 | Lea | 335/205 |
| 3,815,118 | 6/1974 | McDonald | 340/571 |
| 3,846,782 | 11/1974 | Brodsky | 340/545 |
| 3,893,096 | 7/1975 | Tucci et al. | 340/571 |
| 4,064,507 | 12/1977 | Schmitz | 340/541 |
| 4,118,692 | 10/1978 | Fitchett | 340/568 |
| 4,160,972 | 7/1979 | La Mell et al. | 340/545 |
| 4,292,629 | 9/1981 | Kerr et al. | 340/545 |
| 4,603,327 | 7/1986 | Leonard et al. | 340/573 |

*Primary Examiner*—Joseph A. Orsino, Jr.
*Assistant Examiner*—Brian R. Tumm
*Attorney, Agent, or Firm*—Edgar W. Averill, Jr.

[57] ABSTRACT

A handbag, briefcase or luggage alarm of the type which sounds an audible and/or visual alarm when the compartment is opened. The alarm is particularly useful for compartments of the type having a zipper-type opening. The alarm can be disabled by opening the compartment several inches and reaching into the interior thereof and switching off a disarming switch which disables the alarm. The compartment may then be opened the rest of the way. Conversely, when the compartment is closed, the same disabling switch is turned back on when the compartment is almost completely closed. The disarming switch may be replaced by an exterior key pad to program a given number sequence for arming and disarming the device.

13 Claims, 1 Drawing Sheet

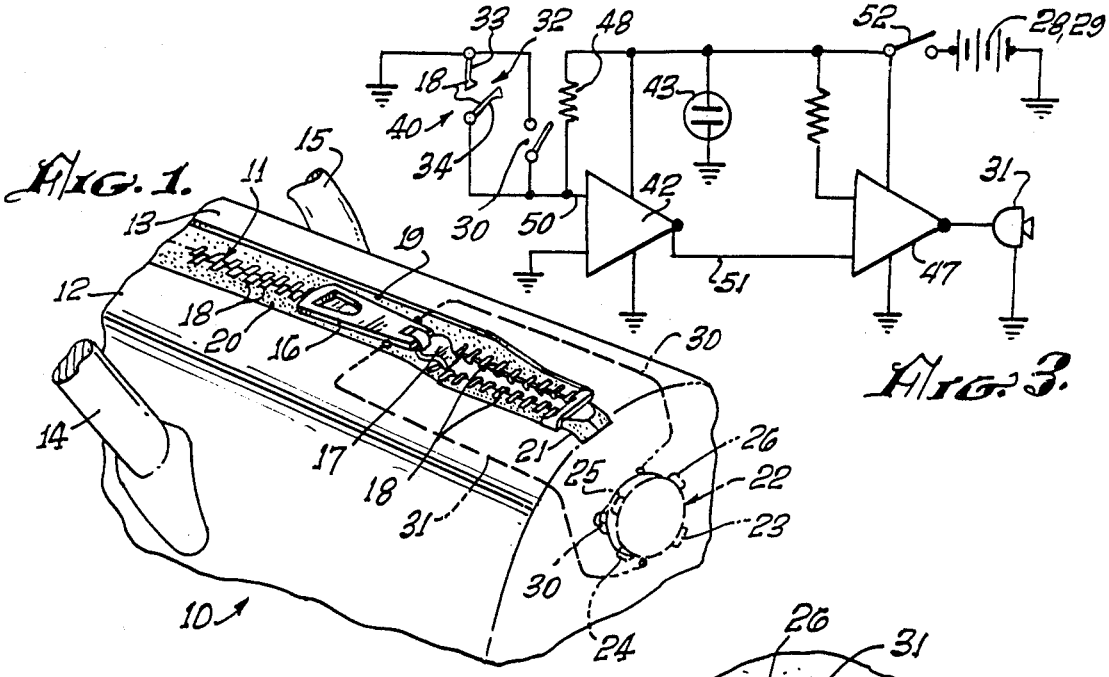
FIG. 1.
FIG. 3.
10
11
12
13
14
15
16
17
18
19
20
21
22
23
24
25
26
28,29
30
31
32
33
34
40
42
43
47
48
50
51
52
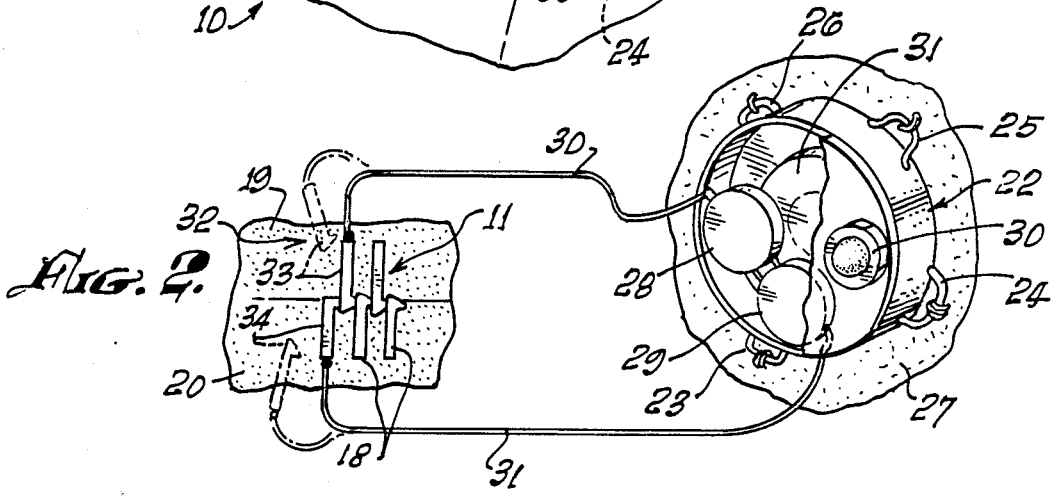
FIG. 2.
11
18
19
20
22
23
24
25
26
27
28
29
30
31
32
33
34
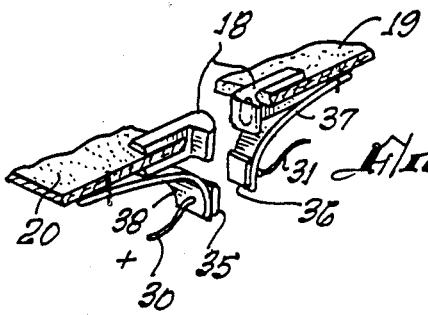
FIG. 4.
18
19
20
30
31
35
36
37
38
+
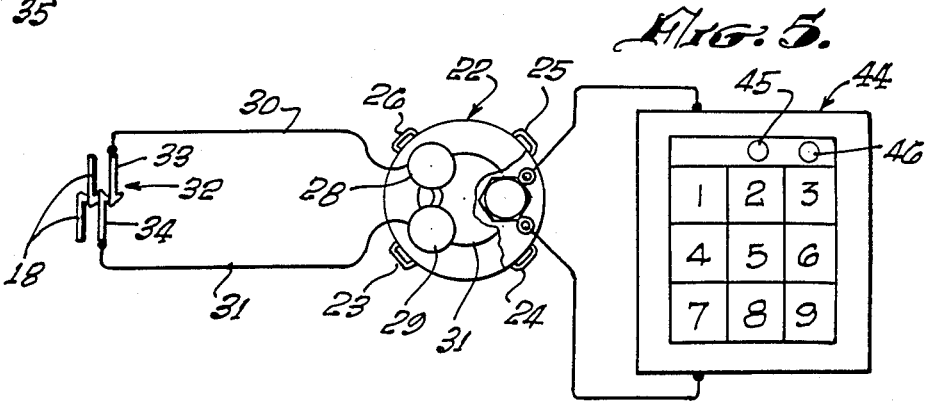
FIG. 5.
18
22
23
24
25
26
28
29
30
31
32
33
34
44
45
46
1
2
3
4
5
6
7
8
9

HANDBAG, BRIEFCASE AND LUGGAGE ALARM

BACKGROUND OF THE INVENTION

The field of the invention is alarms and the invention relates more particularly to alarms useful on handbags, briefcases or luggage or other similar devices more particularly referred to herein as "compartments."

Many types of compartment alarms are limited to a particular type of clasp which, because of the many styles of purses, is thus very limited in use. For instance, the handbag alarm system of U.S. Pat. No. 3,893,096 utilizes an on/off switch together with a pressure-responsive switch operated and disguised by the flap of the purse. Similarly, the bag alarm device of U.S. Pat. No. 4,118,692 utilizes a unique tab which would not have wide application on most styles of purses. The theft alarm of U.S. Pat. No. 3,815,118 utilizes an elastic member fitted over the wrist of the hand grasping the bag which, again, limits the style of purse on which it can be used. The theft alarm of U.S. Pat. No. 1,730,745 requires a special handle to operate. The alarm of U.S. Pat. No. 1,148,773 has an on/off switch located along the top of the hinged opening and also utilizes the handle thereof which, again, limits the style of purse. A zipper-type switch is opened when the purse zipper is completely opened in U.S. Pat. No. 2,538,101. Such switch only operates if the purse is completely opened and, thus, would not be useful to prevent theft which could easily be accomplished by opening the purse less than all the way.

SUMMARY OF THE INVENTION

The present invention is for a compartment alarm which is usable on a wide variety of purses, namely, those with zipper openings.

The present invention is for an improved compartment alarm of the type sounding an alarm within the compartment when a first switch is activated when the compartment is opened when the alarm is not disabled by turning off a second switch. The improvement comprises a compartment including an opening thereon, said compartment having an interior area, and said opening having a first switch means which is toggled only when said opening is opened a distance of at least one inch. A case is positioned within the interior area of the compartment and the case has an audible sound generator or a visable light means and a battery therein. A triggering circuit is activated by the opening of the first switch means and deactivated by the closing of the first switch means. A second, or disarming switch means is positioned within the compartment and reachable by a finger inserted within said compartment when said opening is opened a distance of no more than about one inch. Conductor means connects the aforementioned elements so that the opening of the first switch means will activate the alarm unless the disarming switch is opened. Preferably, the compartment has a zipper-type opening and the first switch means is a part of the teeth of the zipper.

BRIEF DESCRIPTION OF THE DRAWINGS

FIG. 1 is a perspective view of the upper corner of a handbag including the alarm of the present invention.

FIG. 2 is an enlarged view of the zipper-type switch and battery/alarm case of the compartment alarm of FIG. 1.

FIG. 3 is a circuit diagram of the alarm of the handbag of FIG. 1.

FIG. 4 is a perspective view of an alternate embodiment of zipper-type switch of the handbag of FIG. 1.

FIG. 5 is a diagrammatic view of an alternate configuration of the compartment alarm utilizing a sequential keypad.

DESCRIPTION OF THE PREFERRED EMBODIMENTS

The upper corner of a handbag 10 is shown in perspective view in FIG. 1 and has a zipper 11 which connects the two halves 12 and 13 of handbag 10. A fragmentary portion of two handles 14 and 15 is also shown in FIG. 1.

Zipper 11 has a pull tab 16 connected to a slide 17 which separates the teeth 18 in a conventional manner. The teeth are connected to a pair of zipper tapes 19 and 20 and the zipper has a closed end 21 and an open end, not shown, at the other end of the opening of purse 10.

The handbag 10 appears from the exterior to be a normal handbag of a widely used type of design. However, an alarm is affixed, thereto, so that if the handbag is surreptitiously opened when the alarm has been armed, the alarm will sound, warning the owner of the unwanted intrusion. The alarm is shown in FIG. 2 and has a case 22 which has four loops 23 through 26 integral therewith. These loops facilitate the sewing, or otherwise attaching, of case 22 to the inner wall 27 of handbag 10. The case contains two batteries 28 and 29, disabling switch 30 and an audible alarm, or sound generator, 31. It is, of course, contemplated that the alarm could be a visual alarm, rather than an audible alarm, for particular applications when such warning system would be more appropriate. A pair of conductors 30' and 31' lead from the case to a first switch means indicated generally by reference character 32 and more specifically comprising electrical contacts 33 and 34 which are shown as two opposing teeth of the zipper 11. The teeth, of course, in this embodiment must be conductive, either by being fabricated from a conductive material or being coated with a conductive coating. An alternate type of switch is useful when the zipper teeth are made of a non-conductive material and it is not practical to coat the same. In this instance, a pair of conductive contacts 35 and 36 are used. The contacts are affixed to flexible tapes 37 and 38 which are sewn, or otherwise affixed, to zipper tapes 19 and 20. It is preferable in this configuration that the contacts 35 and 36 be permanent magnets so that they will form a continuous contact automatically when the zipper is closed by the magnetic attraction of one to the other. Alternatively, a mechanical type of clip could also be used where the user could mechanically snap the two contacts together.

A schematic, electrical diagram is shown in FIG. 3 which depicts a possible method of causing an alarm to be actuated when contacts 33 and 34 are opened. This utilizes a pair of integrated circuits indicated by reference characters 42 and 47. These are both dual operational amplifiers of the type sold under industry standard No. 1458. When the input 50 is changed by the opening of contacts 33 and 34 at a time when disarming switch 30 is also opened, the output 51 is connected to the input of operational amplifier 47 which, thus, drives audible alarm 31. Resistor 48 is preferably a 5K resistor and resistor 49 is preferably a 1K resistor. An on/off switch 52 is positioned within the compartment to act as a master on/off switch to decrease battery drain when the device is not needed. A ready light 43 can be added to indicate that the circuit is turned on. The circuit shown in FIG. 3 is merely one possible approach and other circuits could alternatively be used as long as they are capable of sounding an alarm when a switch is opened.

Although the drawings and the circuit emphasize the use of a zipper to actuate the first switch means, other types of switches could be used. The important feature of the present invention is that the handbag, briefcase or luggage can be opened a small amount without activating any switch and only when the device is further opened does the alarm sound. Thus, the device could be used in a conventional briefcase with the disarming switch 30 located at a position known to the owner but unlikely to be known by others. In the case of a briefcase, the opening could be as little as one inch to permit the entry of a finger to turn off and disarm the alarm. In the case of a zipper, it is preferable that the opening be about two and one-half inches although one inch could be used.

The disabling switch 30 may be replaced with a sequential keypad, shown in FIG. 5, and indicated by reference character 44. This may have one or more light-emitting diodes 45 and 46 which would warn an intruder of the presence of an alarm.

An important feature of the preferred embodiment of the present invention is the location of the first, or zipper switch, means. As shown best in FIG. 1, this switch is located so that the slide 17 may be pulled a short distance from the closed end 21 without opening the zipper switch. In this way, the user may reach in the opening near the closed end and turn off the second, or disabling switch 30, with his or her finger. The pull tab 16 may then be used to open the handbag completely. It may be readily seen that essentially nothing could be removed from the purse when the zipper was opened only the short distance as shown in FIG. 1. Preferably, the disabling switch is a bubble-type switch that is easily operated by pressing thereon. Preferably, the audible alarm is a beeper device that is magnified with a small loudspeaker. A piezo electric speaker is preferred. The alarm could also be used in the pocket of a garment and, preferably, the case is sealed to be waterproof to lengthen the life of the assembly. Although the disarming switch is shown as part of the case in the drawings, it need not be part of the case and instead could be a separate switch if it was desired to have the battery and alarm at a location more remote from the closed end of the zipper. Preferably, the batteries used with the alarm of the present invention are the disk or calculator-type of batteries because of their small size combined with long life. It is preferred that there be at least three loops on the case so that it can be securely sewn and will not tend to catch in any of the articles placed in or taken from the pocket.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved pocket alarm of the type sounding an alarm within the pocket when a first or zipper switch means is toggled when the pocket is opened when the alarm is not disabled by toggling a second or disarming switch means wherein the improvement comprises:

said pocket having a zipper-type opening thereon, said pocket having an interior compartment and said zipper-type opening having an open end and a closed end;

a case positioned within the interior of said pocket having an audible sound generator and battery means therein;

said first or zipper switch means being toggled by unzipping the zipper-type opening of said pocket a distance of about two and one-half inches and remaining in its toggled state while the zipper-type opening is further opened;

circuit means activated by the toggling of said first or zipper switch means and deactivated by the toggling of said first, or zipper switch, means;

said second or disarming switch means positioned within said pocket and reachable by a finger inserted at the closed end of said zipper-type opening when said zipper-type opening is opened a distance of no more than about two and one-half inches; and conductor means connecting the aforementioned elements so that the toggling of the zipper switch means will activate the alarm unless the disarming switch means is in a disarmed condition.

2. The improved pocket alarm of claim 1 wherein said first or zipper switch means comprises two electrically conductive opposed teeth of said zipper-type opening.

3. The improved pocket alarm of claim 1 wherein said first or zipper switch means comprises two opposed contact elements affixed within the interior of said pocket directly below said zipper-type opening at a distance of about two and one-half inches from the closed end thereof, which contacts are toggled by the closing of said zipper-type opening and toggled by the opening of said zipper-type opening.

4. The improved pocket alarm of claim 1 wherein said disarming switch means is affixed to said case.

5. The improved pocket alarm of claim 1 wherein said pocket is a purse.

6. The improved pocket alarm of claim 5 wherein said case is affixed to the inner surface of said purse near and below the closed end of said zipper-type opening.

7. The improved pocket alarm of claim 1 wherein said case has at least three loops formed therein to facilitate the attachment thereof to the interior of the pocket.

8. The improved pocket alarm of claim 1 wherein said battery means comprise two disk-shaped batteries held within said case.

9. An improved compartment alarm of the type sounding an alarm within the compartment when a first switch means is activated when the compartment is opened when the alarm is not disabled by turning off a second or disarming switch means wherein the improvement comprises:

a compartment including an opening thereon, said compartment having an interior area and said opening having said first switch means which is toggled only when said opening is opened a distance of at least one inch;

a case positioned within the interior area of the compartment having an alarm generator and battery means therein;

triggering circuit means activated by the opening of said first switch means and deactivated by the closing of said first switch means;

said second or disarming switch means positioned within said compartment and reachable by a finger inserted within said compartment when said opening is opened a distance of no more than about one inch; and conductor means connecting the aforementioned elements so that the opening of the first switch means will activate the alarm unless the disarming switch means is closed.

10. An improved purse alarm of the type sounding an audible alarm within the interior compartment of said purse when a first or zipper switch means is toggled when the purse is opened when the audible alarm is not disabled by toggling a second or disarming switch means wherein the improvement comprises:

said purse having a zipper-type opening thereto, said zipper-type opening having an open end and a closed end;

a case positioned within the interior of said purse reachable by a finger inserted at the closed end of said zipper-type opening when said zipper-type opening is opened a distance of no more than about two and one-half inches;

an audible sound generator within said case;

battery means affixed to said case;

said first or zipper switch means toggled by unzipping the zipper-type opening of said purse a distance of about two and one-half inches and remaining in its toggled state while the zipper-type opening is further opened, said first or zipper switch means having first and second contacts;

circuit means affixed to said case, said circuit means being operated by the toggling of said zipper switch means;

said second or disarming switch means held by said case;

first conductor means connecting the battery means, the audible sound generator, and the circuit means; and second conductor means connecting said zipper switch means, said battery means and said circuit means, and said disarming switch means being connected to said first or said second conductor means whereby when said disarming switch means is in an armed condition, said circuit means is open, when said zipper switch means is opened by opening the zipper more than about two and one-half inches and said audible sound generator is activated and whereby when said disarming switch means is set to a disarmed condition by inserting a finger in the opening of less than about two and one-half inches, no sound is generated when the zipper-type opening is opened sufficiently to toggle said first or zipper switch means.

11. The improved purse alarm of claim 10 wherein said zipper switch means comprises a pair of opposing conductive teeth on a zipper at the opening of said purse, said teeth located about two and one-half inches from the closed end of the zipper.

12. The improved purse alarm of claim 10 wherein said zipper switch means comprises two opposed contact elements affixed within the interior of said pocket directly below said zipper-type opening at a distance of about two and one-half inches from the closed end thereof, which contacts are closed by the closing of said zipper-type opening and opened by the opening of said zipper-type opening.

13. The improved purse alarm of claim 12 wherein said contact elements are magnetically attracted to each other.

* * * * *